United States Patent [19]

Williams

[11] Patent Number: 4,674,604

[45] Date of Patent: Jun. 23, 1987

[54] ELEVATOR INNER AND OUTER DOOR ZONE SENSOR ARRANGEMENT

[75] Inventor: Walter L. Williams, Denver, Colo.

[73] Assignee: Otis Elevator Company, Farmington, Conn.

[21] Appl. No.: 789,544

[22] Filed: Oct. 21, 1985

[51] Int. Cl.[4] ..... B66B 1/40

[52] U.S. Cl. ..... 187/113; 187/103

[58] Field of Search ..... 187/29 R, 103, 113; 340/19 R, 20

[56] References Cited

U.S. PATENT DOCUMENTS

| | | | |
|---|---|---|---|
| 3,261,427 | 7/1966 | Morris | 187/29 R |
| 4,245,721 | 1/1981 | Masel | 187/29 R |
| 4,346,788 | 8/1982 | Shung | 187/29 R |
| 4,362,224 | 12/1982 | Fairbrother | 187/29 R |

*Primary Examiner*—William M. Shoop, Jr.
*Assistant Examiner*—Richard K. Blum

[57] ABSTRACT

Two signals are provided for dissimilar inner and outer door zones in either direction of elevator travel by a vane (20) of length (d) mounted to the elevator hoistway at a landing, and three sensors (26,28,30) mounted to the elevator cab; an upper sensor (26), a lower sensor (30) disposed at a distance less than d below the upper sensor, and a middle sensor (28) disposed midway between the upper and lower sensors.

The contemporaneous provision of vane/sensor proximity signals from the upper and middle sensors is indicative of the cab being in the outer door zone for the landing when the cab is traveling in an upward direction.

The contemporaneous provision of vane/sensor proximity signals from the lower and middle sensors is indicative of the cab being in the outer door zone for the landing when the cab is traveling in a downward direction.

The contemporaneous provision of vane/sensor proximity signals from the upper and lower sensors is indicative of the cab being in the inner door zone for the landing when the cab is traveling in either direction.

2 Claims, 2 Drawing Figures

ELEVATOR INNER AND OUTER DOOR ZONE SENSOR ARRANGEMENT

TECHNICAL FIELD

The invention relates to the opening of elevator doors.

BACKGROUND OF THE INVENTION

Electrical interlocks prevent elevator door opening during a run. In fact, safety devices will shut down the elevator if the door opens away from a stop. However, it may be desirable to begin opening the door in advance of stopping at a landing.

Safety codes define an outer door zone (ODZ) for a destination landing, at which point the doors are allowed to begin opening if the car is below a code-defined speed limit. Sensors at the outer door zone signal elevator cab presence thereat and are part of a bypass of safety devices inhibiting car motion with open doors. It will be assumed hereinafter that car speed and arrival at a destination appropriately constrain the bypass closure in addition to the proximity of the car to a floor.

An inner door zone (IDZ) is also defined, either less than or equal to the width of the outer door zone, at which point codes allow for slow velocity movement of the cab for leveling, with the doors open.

In the case of dissimilar inner and outer door zones, typical prior art door zone sensors employ two sensors for each door zone (IDZ and ODZ), a total of four sensors, since a single sensor failure cannot be allowed to bypass the safety devices. A typical outer door zone is =/− twelve inches (300 mm) from the landing, and a typical inner door zone is +/− three inches (75 mm) from the landing, for this case.

DISCLOSURE OF THE INVENTION

It is an object of this invention to provide a simple, reliable door zone sensor for an elevator using fewer than four sensors in the case of dissimilar inner and outer door zones.

According to the invention a vane of length (d) is mounted to the elevator hoistway. Three sensors are mounted to the elevator cab to detect the vane; an upper sensor, a lower sensor disposed at a distance less than d below the upper sensor, and a middle sensor disposed midway between the upper and lower sensors.

The contemporaneous provision of vane/sensor proximity signals from the upper and middle sensors is indicative of the cab being in the outer door zone when the car is traveling in an upward direction.

The contemporaneous provision of vane/sensor proximity signals from the lower and middle sensors is indicative of the cab being in the outer door zone when the car is traveling in a downward direction.

The contemporaneous provision of vane/sensor proximity signals from the upper and lower sensors is indicative of the cab being in the inner door zone when the car is traveling in either direction.

Other objects, features, and advantages of the invention will become apparent in light of the following description thereof.

BEST MODE FOR CARRYING OUT THE INVENTION

Figure 1:
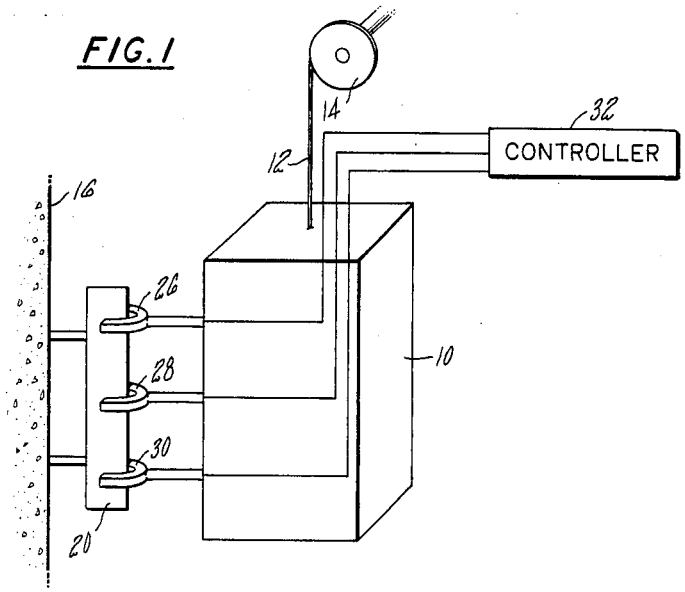
FIG. 1 is a schematic block diagram of the components of this invention.

FIG. 1 shows an elevator cab 10 suspended by a cable 12 from a motor-driven sheave 14 in a hoistway 16. An elongated metal vane 20 of length (d) is mounted lengthwise in the hoistway 16. In this example, the vane is twenty-four inches (600 mm) in length. Three magnetic, U-shaped pickups; an upper pickup 26, a middle pickup 28, and a lower pickup 30 are mounted to the cab 10 so that as the cab 10 passes the vane, the vane passes through the pickups. Indications of vane/pickup proximity are transmitted to a controller 32, to allow door opening without breaking the safety chain; i.e., by bypassing the open door contacts in the safety chain. In this example, the pickups 26 and 30 are spaced eighteen inches (450 mm) apart, and the pickup 28 is disposed midway between the two other pickups.

Figure 2:
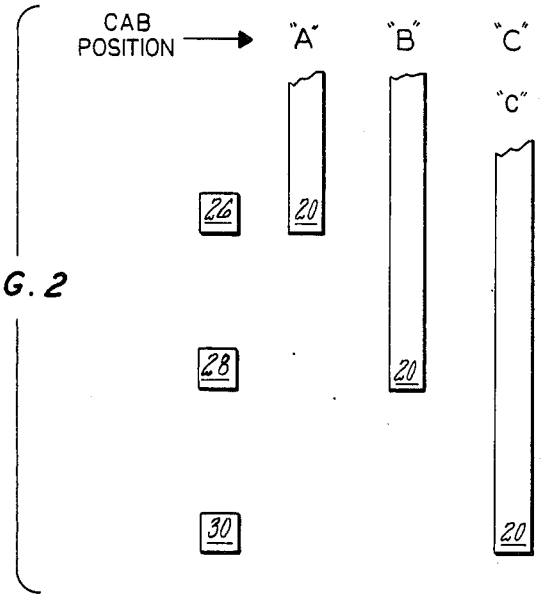
FIG. 2 is a graph illustrating the operation of the invention.

The graph of FIG. 2 shows the signals transmitted by the pickups 26–30 to the controller 32 as the cab 10 approaches the vane 20 in an upward direction. By definition, when the middle pickup 28 is adjacent the midpoint of the vane, the car is level at the landing.

At position "A", the lower end of the vane 20 is adjacent the upper pickup 26. This means that the cab is twenty-one inches (525 mm) from level, as the cab must travel eighteen inches (450 mm) plus three inches (75 mm) until the middle sensor 28 is centered on the vane 20. This is not a significant position for zone determination, but does allow the controller to check the validity and sequencing of subsequent signals.

At position "B" the lower end of the vane is adjacent the middle pickup 28. This means that the cab is twelve inches (300 mm) from level. From this position to level is known as the outer door zone, or leveling zone, at which point codes allow for door opening to begin in anticipation of a stop at that landing. For any position within the next nine inches (225 mm) of upward cab travel, only the sensors 26 and 28 signal the controller 32.

At position "C", the lower end of the vane is adjacent the lower pickup 30. This means that the cab is three inches (75 mm) from level. From this position to level is known as the inner door zone for some codes, at which point codes allow for slow velocity movement of the cab for releveling, with the cab doors open. Since the vane is six inches (150 mm) longer than the span between the upper and lower pickups, the upper pickup 26 and the lower pickup 30 signal the controller 32 at this position and for any position within the next six inches (150 mm) of upward cab travel. Thus the inner door zone is plus-or-minus three inches (75 mm) of level, in this example.

In the downward direction of cab travel, the onset of contemporaneous signals from the lower pickup 30 and the middle pickup 28 is indicative of reaching the outer door zone, and the onset of contemporaneous signals from the lower pickup 30 and the upper pickup 26 is indicative of reaching the inner door zone.

Thus, it will be appreciated that the three pickups of the present system provide the function of the prior art four pickups, while maintaining a similar degree of safety; i.e., signals from two pickups are required for indicating inner and outer door zones.

We claim:

1. A sensor arrangement providing signals indicative of elevator inner and outer door zones, comprising:

a vane (20), having a length (d), mounted lengthwise in the elevator hoistway (16) and associated with a landing;

an upper sensor (26) mounted to the cab (10) for providing a first signal indicative of upper sensor/-vane proximity;

a lower sensor (30) mounted to the cab (10) at a distance twice the inner door zone dimension less than the vane length below the upper sensor (26) for providing a second signal indicative of lower sensor/vane proximity;

a middle sensor (28) mounted to the cab (10) midway between the upper sensor (26) and the lower sensor

(30) for providing a third signal indicative of middle sensor/vane proximity;

wherein the contemporaneous provision of the first and third signals is indicative of the cab being in the outer door zone for the landing, when the cab is traveling in the upward direction;

wherein the contemporaneous provision of the second and third signals is indicative of the cab being in the outer door zone for the landing, when the cab is traveling in the downward direction; and wherein the contemporaneous provision of the first and second signals is indicative of the cab being in an inner door zone for the landing, when the cab is traveling in either direction.

2. Apparatus according to claim 1 wherein the inner door zone dimension is plus or minus three inches (75 millimeters) of the landing.

* * * * *